United States Patent [19]

Keller

[11] 4,022,471

[45] May 10, 1977

[54] VOLLEYBALL TRAINING AND BLOCKING DEVICE

[76] Inventor: Dennis Herbert Keller, 3475 Witt Road, Auburn, Calif. 95603

[22] Filed: July 28, 1975

[21] Appl. No.: 599,651

Related U.S. Application Data

[63] Continuation-in-part of Ser. No. 501,969, Aug. 30, 1974, Pat. No. 3,897,950.

[52] U.S. Cl. ..... 273/102.4; 273/95 R; 273/102 S

[51] Int. Cl.[2] ..... A63B 71/02

[58] Field of Search ..... 273/30, 95 R, 102 R, 273/102 S, 102.4, 103; 248/121, 222

[56] References Cited

UNITED STATES PATENTS

| | | | |
|---|---|---|---|
| 2,026,097 | 12/1935 | Nicolich | 248/122 |
| 2,453,967 | 11/1948 | Browne | 248/122 |
| 3,088,735 | 5/1963 | Clark | 273/30 |
| 3,133,734 | 5/1964 | Latham | 273/30 |
| 3,341,201 | 9/1967 | Ryan | 273/95 R |
| 3,794,322 | 2/1974 | Rosekrans | 273/95 R |

*Primary Examiner*—Richard C. Pinkham
*Assistant Examiner*—Vance Y. Hum
*Attorney, Agent, or Firm*—John E. Wagner

[57] ABSTRACT

A device for assisting in the training of volleyball players to learn the art and defense to the play known as spiking. This device is a holder for a volleyball at selected elevations near the volleyball net or a rebound surface. The holder allows a player to run, jump and strike the ball in a manner to drive it with great energy over the net and into opposing team's territory. The rebounder deflects a spiked ball in an unpredictable direction. The rebounder comprises a plurality of arms spaced less than a volleyball diameter apart and constituting an operating head. The operating head is positioned adjustably by a standard, whereby it may be located above and adjacent to a volleyball net to deflect unpredictably volleyballs spiked against it, for training of the defense to volleyball spiking.

10 Claims, 12 Drawing Figures

VOLLEYBALL TRAINING AND BLOCKING DEVICE

REFERENCE TO RELATED APPLICATIONS

This is a continuation-in-part of U.S. patent application, Ser. No. 501,969, filed Aug. 30, 1974, now U.S. Pat. No. 3,897,950.

BACKGROUND OF THE INVENTION

The play of spiking is one of the most interesting in the game of volleyball and one for which volleyball players take great pleasure in establishing or setting and then completing. It involves more required coordination on the part of the spiking player than any other play in the sport and consequently is more difficult than any other play. Successful spiking requires that the ball be set, that is, lofted by a companion player into position such that it beings its descending arc almost vertically and in a position adjacent to the net and not over the net or accessible to defensive players. The spiker must be able to run or jump to meet the ball on its descending route, strike it while it is still above the level of the nut and direct it over and downward into opposing territory.

The play of spiking when being set up is obvious to the opposing team which allows them as players, to assume defensive positions. This makes the art of spiking even more difficult since the spiking player must not only coordinate his move with that of the set ball, but he must be able to watch opposing players, analyze their defense and spike to avoid them.

Because the spiking step is one which involves a dynamic situation of both the ball and the spiking player as well as the defensive players, the training of spikers is difficult.

Spiking defense, on the other hand, involves one or more players jumping at the appropriate time and location, and presenting a barrier with their open hands and arms. If successful, the defense players cause a rebound at high velocity and unpredictable direction.

BRIEF STATEMENT OF THE INVENTION

I have discovered that it is possible to segregate the separate steps in spiking and thereby facilitate the training of volleyball players. I have segregated the steps of the actual spike from that of playing the set through the use of a device including a support and a pair of arms at adjustable height above the ground level. The arms include flexible holders which cradle the volleyball at the correct position for the learning player to spike. The device is adjustable in height to teach the effects of the height of the ball at the time of the spike and also it is useful in teaching defensive players how to combat the spike.

In its alternate embodiment, a substitute head for the spike training device is an array of spaced bars which, when struck with a spiked volleyball, will return the volleyball in an unpredictable direction and velocity depending upon its attitude when it is struck. This is comparable to the unpredictable nature of the block of a spike by a trained defensive player. It is adjustable in height and atitude as well.

In a second alternate embodiment, the substitute head for the training device includes an array of spaced bars which extend in a vertical direction as opposed to a horizontal direction. Likewise, the frame member supporting the vertical bars is slightly concave in order to provide a limit for lateral return of the ball.

BRIEF DESCRIPTION OF THE DRAWING

This invention may be more clearly understood by the following detailed description and by reference to the drawings in which.

DETAILED DESCRIPTION OF THE INVENTION

As indicated above, the object of this invention is to place a volleyball in certain positions for the training of spiking and of the defense to spiking. In spike training the volleyball is positioned in the region of the net and at a selected height so that the player may have a virtually unobstructed view of the net, opposing players or defensive devices, and the ball, and be able to strike the ball without interference just as in the case of actual play. Each of these requirements are met by the device of FIG. 1.

Figure 1:
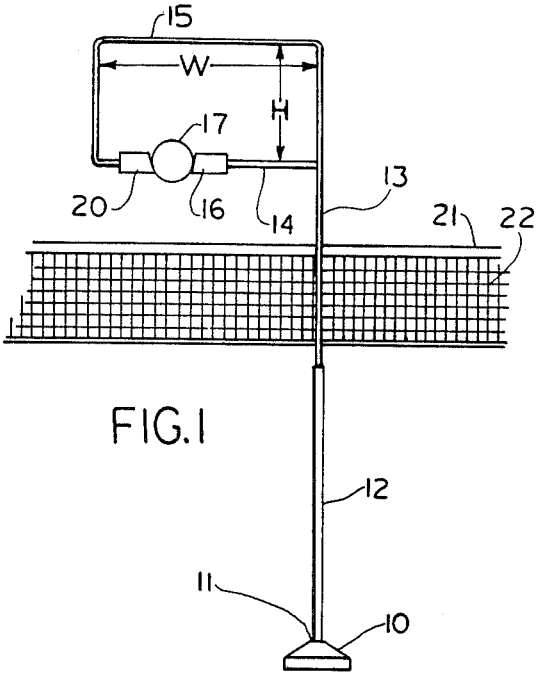
FIG. 1 is a side elevational view of a spike training device in position for use.

Now referring to FIG. 1, the volleyball training device includes a base 10 which may be merely the crutch tip type of base or, as shown in the drawing, a heavy base 10, sufficient to hold the device upright when in use. As is shown in the drawing, the base 10 is a hollow plastic body which may be filled with either sand or water to provide the necessary weight. It includes a recess 11 into which a support standard 12 is positioned. Extending in telescoping relationship with the support standard 12 is the operating head 13 which includes a pair of arms 14 and 15 having ball holders 16 and 20. The arm 15 is generally C shaped and constitutes an extension of the operating head 13 having sufficient height H and sufficient width W to provide a free clearance area for the player.

Figure 2:
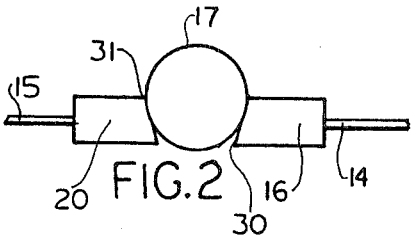
FIG. 2 is an enlarged fragmentary front elevational view of the ball holding head of this invention.

Now referring to FIG. 2 for the details of the ball support 16 and 20 where they may be more clearly seen, the support members 16 and 20 are preferably of all foam plastic such as polystyrene having tapered inward extending faces, 30 and 31 respectively. The supports 16 and 20 are of sufficient length to telescope over the ends of the arms 14 and 15. Therefore the entire region adjacent to the ball 17 has a soft plastic consistency to protect the hands of the spiker. The tapered surfaces 30 and 31 cradle the ball 17 and release it upon being struck by the spiker's hand. I have found that the use of foam plastic effectively cradles the ball 17, and the spiker hardly detects any support, particularly at the moment of impact. This simulates as closely as possible the ball in free flight at the time of spiking.

In accordance with this invention, the support 12 and operating head 13 are manufactured of anodized tubular aluminum. For example, its head exhibits a degree of flexibility and lightness in weight so that it may be easily moved and stored. In use, it is recommended that in addition to the support given by the base 10, a player hold the support standard 12 during use, to prevent overturning of the device in the event of a direct blow by an inexperienced player to the operating head. The holding person may well be trainer or coach who can readily observe at close hand the student spiker.

I have found that the device, in accordance with this invention, must be light weight to afford easy handling and storage and the arms 14 and 15 must exhibit a degree of flexibility to allow easy movement of the ball 17 from its support 16 and 20 without interference with the direction or velocity of the spiked ball. This requirement of flexibility is achieved employing aluminum tubing as specified above.

Figure 3:
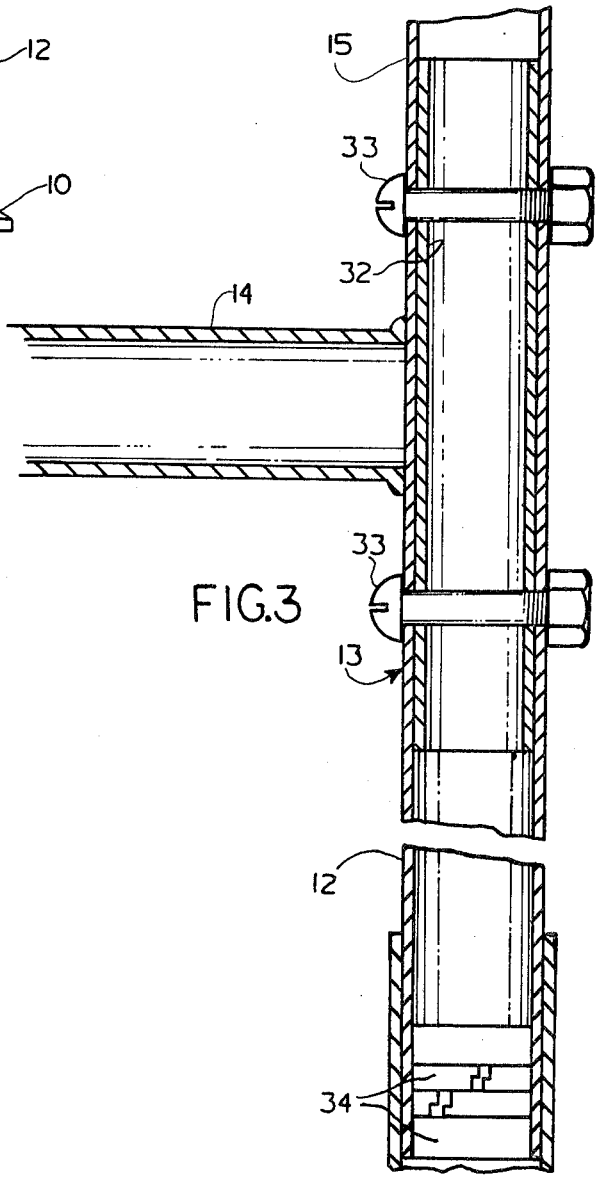
FIG. 3 is a fragmentary vertical section to the support portion of the device of this invention.

When subject to actual play, the points of greatest strain on the device are at the junction of the arms 14 and 15 in the operating head 13. I have found that the required flexibility in the operating head may be maintained while significant strength and resistance to permanent deformation or breakage may be accomplished in a manner as shown in FIG. 3. Now referring to FIG. 3, which is a sectional view at the intersection of the arms 14 and 15, the arm 14 is secured as by welding with the fillets apparent in the drawing. Within the tube 13, coextensive with the region of the intersection of arm 14 and 15, is an internal reinforcing tube 32 which is secured to the operating head 14 and arm 15 portion by a pair of machine bolts or other similar equivalent fasteners 33. In actuality, the stiffening member 32 and bolt 33 may also serve an additional function. That is that because of the size of the training device, it is sometimes desirable to segment it for storage. When such is the case, it is possible to have a seam between the arm 15 and the operating head 13 and between the bolts 33 and the stiffening member 32 which serves as an interconnecting member. In such case, the entire assembly may be reduced to approximately ⅓ of its maximum dimension as shown in FIG. 1. The principal purpose, however, of stiffening member 32 is to provide the strength for arms 14 and 15 while allowing the arms 14 and 15 per se to be flexible for light restraint on the ball 17.

At the bottom of the operating head 13 there is a locking device of the twist lock type which allows the standard 12 and operating head 13 to be telescoped and locked at the appropriate height by twisting parts 12 and 13 with respect to each other. A particularly desirable lock for this purpose is illustrated in U.S. Pat. Nos. 3,095,825 and 3,515,418. Suffice it to say the lock 34 is effective to securely bind the operating head 13 to the standard 12 at any desired height ready for use as illustrated in FIG. 1.

As indicated above, the training of a student spiker also allows the training of defensive players who position themselves on the opposite side of the net ready to attempt to block and return the spiked ball. When the defensive players are successful, the returned ball reflecting the high energy of a spiked ball and the closeness of the defensive players to the net allows the return ball to travel at high velocity in unpredictable direction.

Incorporating the substitute head for the assembly of FIG. 1, the simulation of a return spike may be accomplished. This defensive training device appears in FIG. 4.

Figure 4:
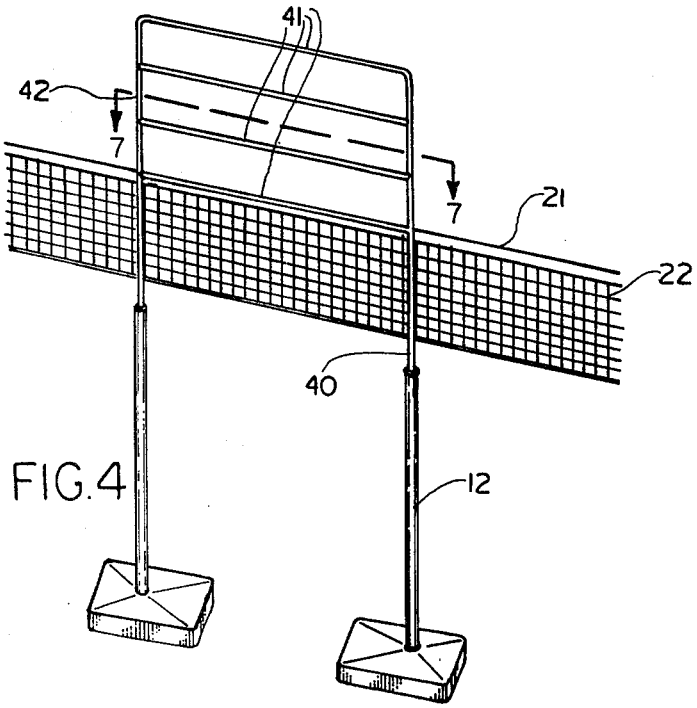
FIG. 4 is a perspective view of an alternate embodiment of this invention.
Figure 5:
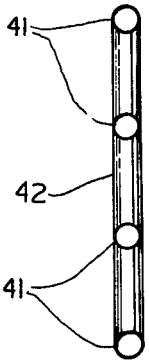
FIG. 5 is a vertical section through the head of the embodiment of FIG. 4 taken along lines 5—5.
Figure 6:
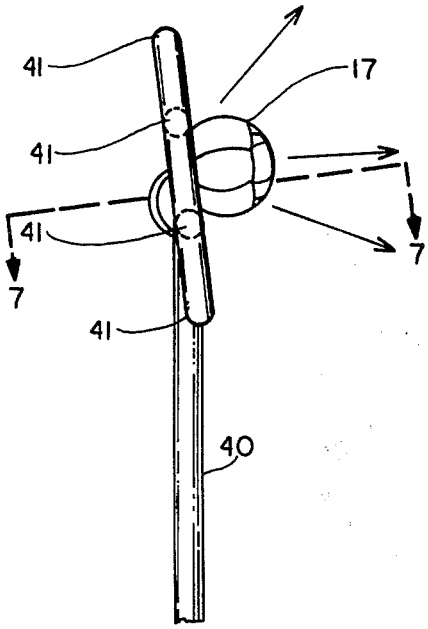
FIG. 6 is a side elevational view of a variation of the embodiment of FIG. 4.
Figure 7:
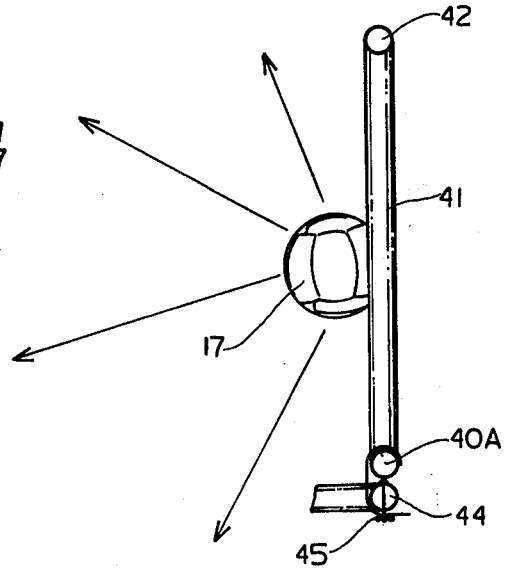
FIG. 7 is a fragmentary sectional view of the apparatus of FIG. 6 taken along lines 7—7 of FIG. 6.

Now, directing our attention to FIG. 4, you may see that the same base 10 in standard 12 is used, in this case, a substitute head 40 comparable to the operating head 13 portion of FIG. 1 being present. The operating head 40 includes a plurality of generally horizontally spaced bars 41 having a spacing therebetween less than the diameter of a volleyball. The use of spaced bars rather than a solid surface is truly significant to this invention. A simple reflective baffle board will serve to predictably return a ball. Players from the earliest ages have learned to detect that the angle of deflection of a ball striking a surface is approximately equal to the angle of incidence. Therefore, a truly representative condition cannot be achieved using a planar deflective surface. In this case, any spiked ball striking the device of FIG. 4 will strike either a single one of the bars 41, the upright 40 or its counterpart at the outer end 42. Striking a single or combination of the bars will result in a totally different direction of rebound. This is illustrated in FIGS. 6 and 7 showing an elevational view in FIG. 6 and a top view in FIG. 7. For example, if the operating bars 41 are in the exact vertical direction and the volleyball, as shown in FIG. 6, strikes midway between two adjacent bars, a direct return can be expected. However, any variation in the direction of incidence and the degree of impact on any one of the bars will unpredictably determine the rebound flight direction. This is true in both the vertical and horizontal planes.

Figure 8:
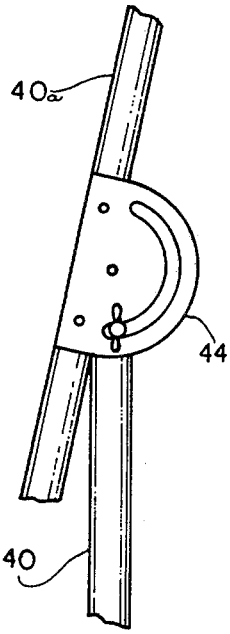
FIG. 8 is a fragmentary side elevational view of the apparatus of FIGS. 6 and 7.

In the case of the rebound trainer of FIG. 4, the bars are all in fixed vertical arrangement. It has been found desirable, however, to change the angle of the array of bars 41. This is accomplished, as illustrated in FIGS. 6, 7 and 8, wherein the operating head 40 has an auxiliary member 40*a*, best seen in FIG. 8. The bars 41 are fixed to member 40*a* instead of head 40 and a sector vertical adjustment member 44 engages the operating head 40 and its adjustable counterpart 40*a*. Thus, by simply loosening a wing nut 45 and changing the angle of section 44, the entire array may be adjusted in angularity and the total effect of an impacting ball is changed.

It is apparent that both training devices may be used simultaneously or separately and a single device with both the operating heads 13 and 40 may be used to alternately train spikers and defenders.

Figure 9:
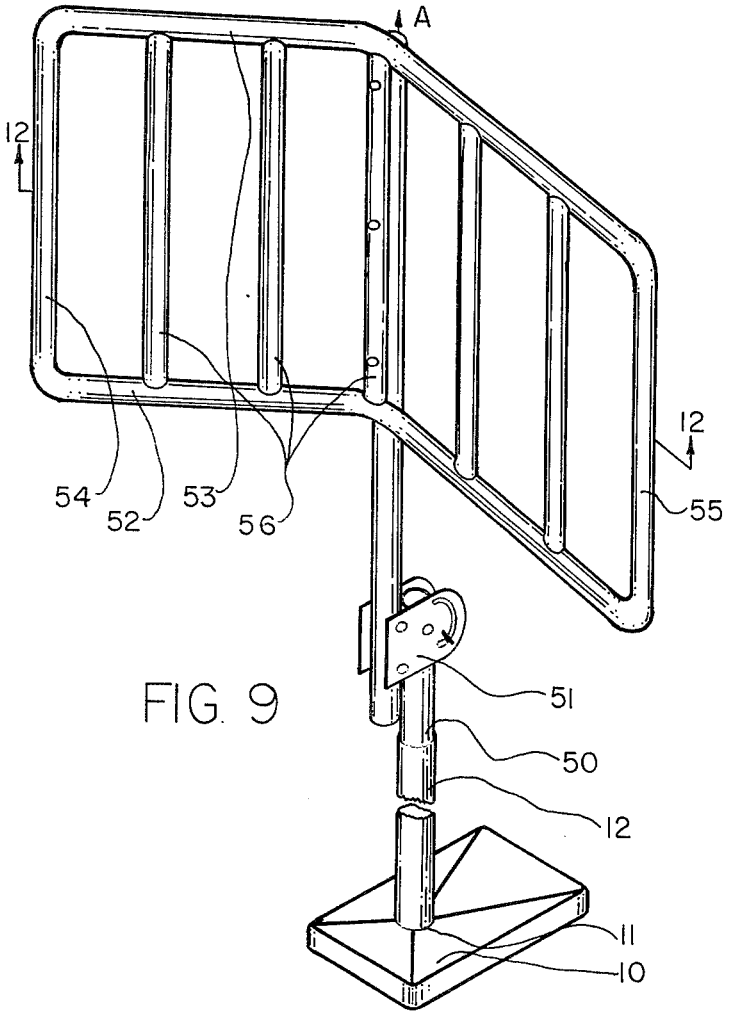
FIG. 9 is a perspective view of an alternate embodiment of this invention.

Now referring to FIG. 9, one may see an alternate embodiment of this invention employing a similar base 10 with a single upright member 12 supported in opening 11 of the base 10 and supporting an operating head 50 which may be pivoted by hinge assembly 51 or may be a single rigid assembly. The operating head includes a lower bar 52 and an upper bar 53 joined by end bars 54 and 55. The upper and lower bars 53 and 52 may be either acute or angular with the angle or center of arc generally at *a*. Joining the upper and lower bars 53 and 52 are a number of intermediate bars 56. The vertical members may be variable in number and variable in spacing provided the spacing between adjacent members is less than the diameter of a volleyball. In the drawing as shown, there are five vertical members 56 between the ends of 54 and 55 and there are all shown in a vertical array. It may be recognized that by bending the assembly at the hinge 51, the angle of attack and return may be changed for the device and further, that the bars 56 need not all be parallel.

One other feature which is apparent in FIG. 9 is that a single central support member is employed. This is, of course, an advantage over the embodiment of FIG. 4, where two supports are used with the resultant increase in total cost.

Of additional significance is the fact that the embodiment of FIG. 9 is not planar but with the angle, tends to return balls into the playing area. The angular form appears in FIG. 10.

Figure 10:
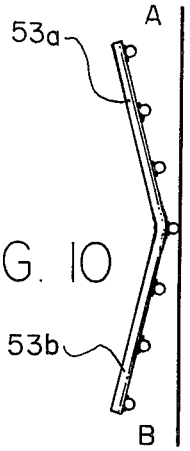
FIG. 10 is a top plan view of the operating head of the embodiment of FIG. 9.

Now referring to FIG. 10, the angularity of the operating head may be clearly seen. In the embodiment of FIG. 9, the device includes straight portions for the top and bottom members 53 and 52, of which top member 53 is visible and each side section 53*a* and 53*b*, offset by an angle A or B respectively. The angles A and B may be equal for a symetrical design or they may be different. I have found that the degree of angularity up to 20° is desirable to maintain the ball on the court, when in use, and also to provide a near reasonable simulation of actual play in spiking defense. This is particularly true since the spike defense player will not normally attempt to rebound the ball directly at the spiker, but to one side or the other.

Figure 11:
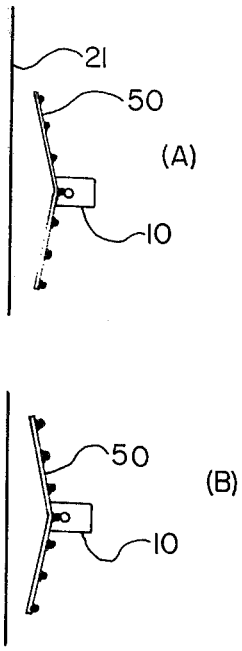
FIG. 11 is a fragmentary top plan view of the embodiment of FIG. 9 shown in playing position.
Figure 12:
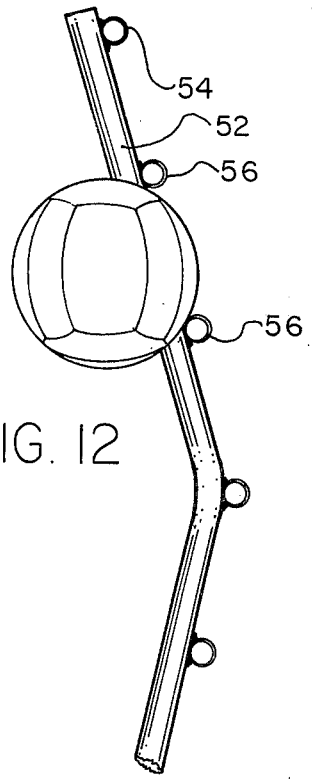
FIG. 12 is an enlarged fragmentary sectional view along lines 12—12 of FIG. 9.

The typical play angles are illustrated in FIG. 11 where at the top the spiker has spiked direct onto the operating head 50 over the net 21. The rebound is at an angle with respect to the net. Below, in FIG. 11*b*, in the position shown similar to that of FIG. 11*a*, an angular rebound which more or less matches the angle of deviation of the head, provides a near direct rebound. It must be taken into account that in addition to the effect of the angle of the head, the principal factor in determining the angle of rebound of the ball is the uncontrolled and random relationship that occurs depending upon whether the ball strikes directly between two upright figure members 56 as illustrated in FIG. 12, or strikes one bar in 56 alone, or any other intermediate possibility. Therefore, the spiker cannot really predict where the return will be, adding to the effective training of the spiker.

As is fairly apparent from a comparison of the blocking devices of FIG. 4 and FIG. 9, the device of FIG. 4 illustrated in FIG. 7, generally produces a return of the spike which deviates from the angle of incidence principally in the vertical plane, while the device of FIG. 9 provides principally lateral deviation. By periodic exchange of heads, the training of the spiker may be enhanced. Also, employing the embodiment of FIG. 9, the change of angularity by action at the hinge 51 enhances the vertical displacement on rebound. In each embodiment, the operation is significantly superior to any planar surface device.

The above described embodiments of this invention are merely descriptive of its principles and are not to be considered limiting. The scope of this invention instead shall be determined from the scope of the following claims, including their equivalents.

What is claimed is:

1. A volleyball training device for use with a regulation volleyball having a prescribed diameter D comprising a standard to be positioned adjacent to a volleyball net;

an operating head engaging such standard and including a plurality of arm members extending from said standard and defining a substantially open region to view therethrough yet a barrier to prevent the passage of volleyballs of diameter D therethrough;

said arm members spaced less than a volleyball diameter D apart but at such distance that a volleyball may simultaneously stroke either one or two of said arm members.

2. The combination in accordance with claim 1 wherein a pair of said arm members are generally horizontal and spaced vertically apart and are interconnected by generally vertical members thereby defining a plurality of spaced bars enclosed by an outer frame.

3. The combination in accordance with claim 1 including means for pivoting said operating head with respect to said standard to change the angle of rebound of any volleyball infringing upon any operating head.

4. A volleyball training device for use with a regulation volleyball having a prescribed diameter D comprising:

a standard to be positioned adjacent to a volleyball net;

an operating head engaging said standard and including a plurality of arm members extending from said standard and defining a barrier for preventing the passage of volleyballs therethrough;

said arm member spaced less than a volleyball diameter D apart;

wherein said arm members define a pair of planar rebound surfaces intersecting at a generally vertical line and each planar surface having an angular deviation from a plane generally parallel to the net of a volleyball playing court of 20° or less.

5. A volleyball training device for use with a regulation volleyball having a prescribed diameter D comprising:

a standard to be positioned adjacent to a volleyball net;

an operating head engaging said standard and including a plurality of arm members extending from said standard and defining a barrier for preventing the passage of volleyballs therethrough;

wherein said operating head includes an array of generally vertical bars, each spaced less than the said volleyball diameter D apart;

wherein said vertical bars are joined by a top bar and a bottom bar defining a closed grill structure;

wherein said top and bottom bars position said vertical members in a non-planar array whereby the angle of rebound of volleyballs striking the operating head may be different depending upon the region of the operating head struck by a volleyball.

6. The combination in accordance with claim 5 wherein said top and bottom members are curved to produce a concave array of bars.

7. The combination in accordance with claim 5 wherein said top and bottom bars define two generally planar portions, each having a uniform angular offset with respect to a plane through the axis of the support and with respect to each other.

8. In combination, a volleyball net supported at an elevated position above the level of a volleyball court;

a regulation diameter volleyball and a volleyball blocking training device comprising a standard to be positioned on the court adjacent to one side of said volleyball net;

an operating head supported by said standard at a level equal or above the uppermost level of the volleyball net;

said operation head including a plurality of arm members extending from said standard in a position generally parallel to the volleyball net and defining a region which is substantially open to view therethrough yet constituting a barrier to the passage of regulation volleyballs of diameter D therethrough;

said arm members being spaced less than a regulation volleyball diameter D apart but at such distance that a volleyball may simultaneously strike either one or two of said arm members.

9. The combination in accordance with claim 8 wherein a pair of said arm members are generally horizontal and spaced vertically apart and are interconnected by generally vertical members thereby defining a plurality of spaced bars enclosed by an outer frame.

10. The combination in accordance with claim 8 including means for pivoting said operating head with respect to said standard to change the angle of rebound of regulation volleyballs of diameter D impinging upon said operating head.

* * * * *